United States Patent [19]

Barker

[11] 4,257,188

[45] Mar. 24, 1981

[54] TOY DOLLS AND FIGURINES HAVING SURFACE PORTIONS OF REVERSIBLY CHANGEABLE COLOR

[75] Inventor: David L. Barker, Sarasota, Fla.

[73] Assignee: CPG Products Corp., Minneapolis, Minn.

[21] Appl. No.: 7,548

[22] Filed: Jan. 30, 1979

[51] Int. Cl.[3] ..... A63H 9/00; A63H 3/24

[52] U.S. Cl. ..... 46/156; 46/135 R; 46/141

[58] Field of Search ..... 46/135 R, 141, 151, 46/156, 162, 154, 1 R

[56] References Cited

U.S. PATENT DOCUMENTS

| | | | |
|---|---|---|---|
| 1,730,177 | 10/1929 | Van Cleave | 46/156 |
| 2,080,439 | 2/1936 | Schaeffer | 46/141 |
| 2,445,994 | 7/1948 | Benson et al. | 46/1 R |
| 2,656,647 | 10/1953 | Schepp | 46/156 |
| 2,781,611 | 2/1957 | Bills et al. | 46/135 R |
| 2,921,407 | 1/1960 | Wagner et al. | 46/156 |
| 2,931,136 | 4/1960 | Loewy | 46/135 R |
| 2,959,891 | 11/1960 | Barnett et al. | 46/135 R |
| 3,382,607 | 5/1968 | Ryan et al. | 46/156 |
| 3,722,070 | 3/1973 | Shiner | 46/162 |
| 4,075,782 | 2/1978 | Neuschatz | 46/135 R |

*Primary Examiner*—F. Barry Shay

*Attorney, Agent, or Firm*—John A. O'Toole; Gene O. Enockson

[57] ABSTRACT

Toy figurines including toy dolls are disclosed that have skins or exterior surfaces repeatedly capable of reversibly changing color. The skin is coated with a sealant/-primer base coat of flexible, hydrophobic film-forming polymeric material. Applied over the base coat is a color layer which is either continuous or of desired geometric configuration. The color layer contains acid-base indicating material, preferably microencapsulated, matrixed in a mixture of polymeric material. A top coat applied over the color layer protects the color layer against abrasion and is water permeable. The coated skin portions thus change color in response to changes in the pH of aqueous solutions applied to them.

20 Claims, 7 Drawing Figures

FIG. 1
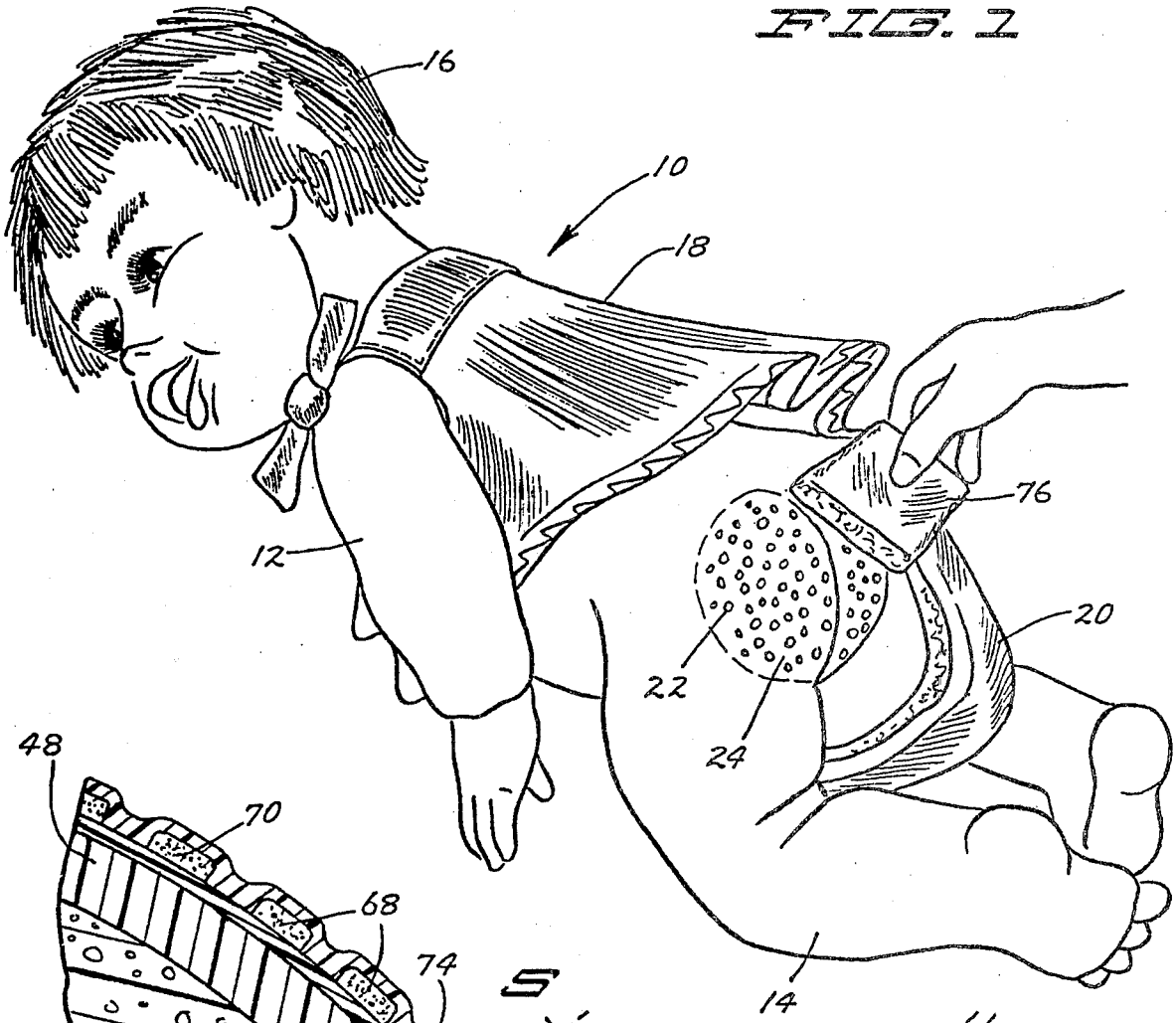
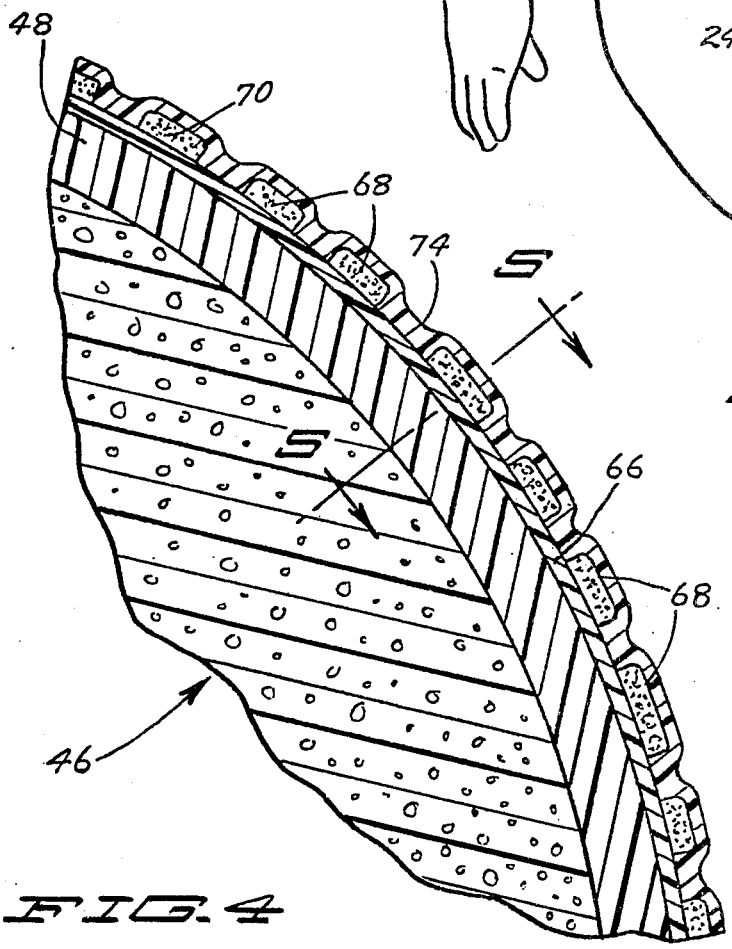
FIG. 4
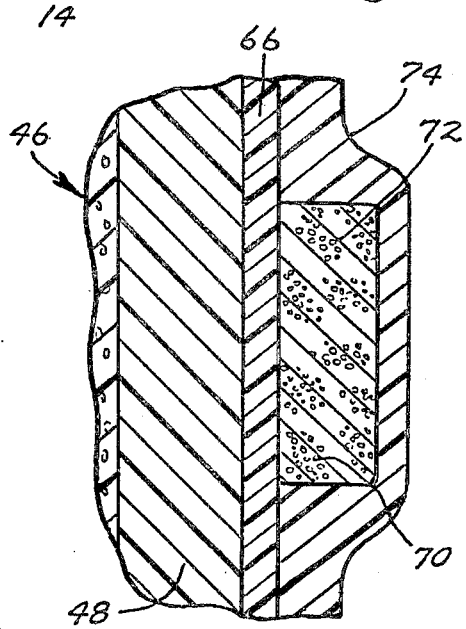
FIG. 5

TOY DOLLS AND FIGURINES HAVING SURFACE PORTIONS OF REVERSIBLY CHANGEABLE COLOR

BACKGROUND OF THE INVENTION

1. Field of the Invention

The present invention relates to toy dolls and other figurines. More particularly, it relates to dolls and other figurines having skins or exterior surfaces repeatedly capable of reversibly changing color in response to changes in the pH of water solutions applied thereto.

2. The Prior Art

The amusement and entertainment derived from toy dolls, figurines and the like is fundamentally related to their ability to mimic the physical geometry, movements, appearances or functions of the real life figures which they represent. Illustrative of such effects presently incorporated in construction of such toys are "talking dolls", "weeping dolls", "sleeping dolls", "walking dolls", etc.

In particular, dolls have also been made which simulate topical features such as dolls which change complexion (see, for example, U.S. Pat. No. 2,931,136 issued Apr. 5, 1960 to E. M. Loewy). Such dolls have chambers containing two immiscible liquids of differing colors. Simulation of complexion changes are achieved by altering the position of the doll to expose one or the other of the colored fluids to view. However, such dolls suffer from the disadvantage that every movement during play causes alterations in the skins' features.

Other dolls have been provided in the past which reversibly simulate changes in skin or surface color or condition by the provision of a series of removably detachable elements adapted to be attached to the doll (see, for example, U.S. Pat. No. 2,959,891 issued Nov. 15, 1960 to H. E. Barnett, et al). A wide variety of skin conditions, ailments and diseases can be simulated which are not subject to random change with alteration of the doll's position. However, a plurality of detachable elements are needed which by virtue of their detachability are subject to being lost or misplaced.

Still other dolls are known in the art which reversibly simulate changes in skin color which do not require a plurality of detachable elements. U.S. Pat. No. 2,921,407 (issued Jan. 19, 1960 to C. A. Wagner, et al), discloses dolls which are able to simulate sunburning. Such dolls operate through incorporation of certain phototropic dyes in appropriate transparent bodies or coatings. However, such dolls suffer from three principal disadvantages. First, ultraviolet radiation is usually required to effectuate the color change in the doll's skin such as by exposure to sunlight. While certain artificial light sources can provide the necessary ultraviolet light to effectuate the change in the color of the doll's skin, these artificial light sources are not always readily available and may actually be dangerous to use. Second, the color change usually takes several minutes of exposure to sunlight to complete. Finally, the phototropic dyes which are disclosed are able to simulate only a limited number of colors.

Given the state of the doll art as described above, there is a continuing need for new toy dolls, and other figurines which have surfaces repeatedly capable of reversibly changing color without the need for prolonged exposure to sunlight. Accordingly, it is an object of the present invention to provide a novel toy or a doll having a surface portion which is reversibly changeable in color.

It is another object of the present invention to provide toy dolls and figurines capable of simulating skin conditions without the need for removably detachable elements.

It is another object of the present invention to provide toy dolls and other figurines which can display changing skin colors or conditions which do not change upon alteration of the position of the doll or other figurine.

It has been surprisingly discovered that the above objects can be realized by toy dolls and figurines employing a surface coating of a material, in combination with a film forming polymeric carrier, that reversibly changes color in response to the pH of aqueous solutions applied to them.

SUMMARY OF THE INVENTION

The present invention relates to toy dolls and other toy figurines which have skin or exterior surfaces repeatably capable of reversibly changing color. In the most preferred embodiment, the toys comprise a body having a resilient skin to which has been applied three layers. The first layer seals the skin to provide a continuous adherent surface. The second layer applied over the first layer and attached thereto is adapted to change color in response to changes in the hydrogen ion activity (pH) of water solutions applied to the second layer. A third, water permeable layer is super-imposed over the second layer to protect the second layer from abrasion.

BRIEF DESCRIPTION OF THE DRAWINGS

FIG. 1 is a perspective view of a doll embodiment of the present invention;

FIG. 4 is a greatly magnified sectional view of the coated skin taken along lines 4—4 of FIG. 2;

FIG. 5 is an enlarged sectional view of the coated skin taken along lines 5—5 of FIG. 4;

DETAILED DESCRIPTION OF THE PREFERRED EMBODIMENTS

Figure 2:
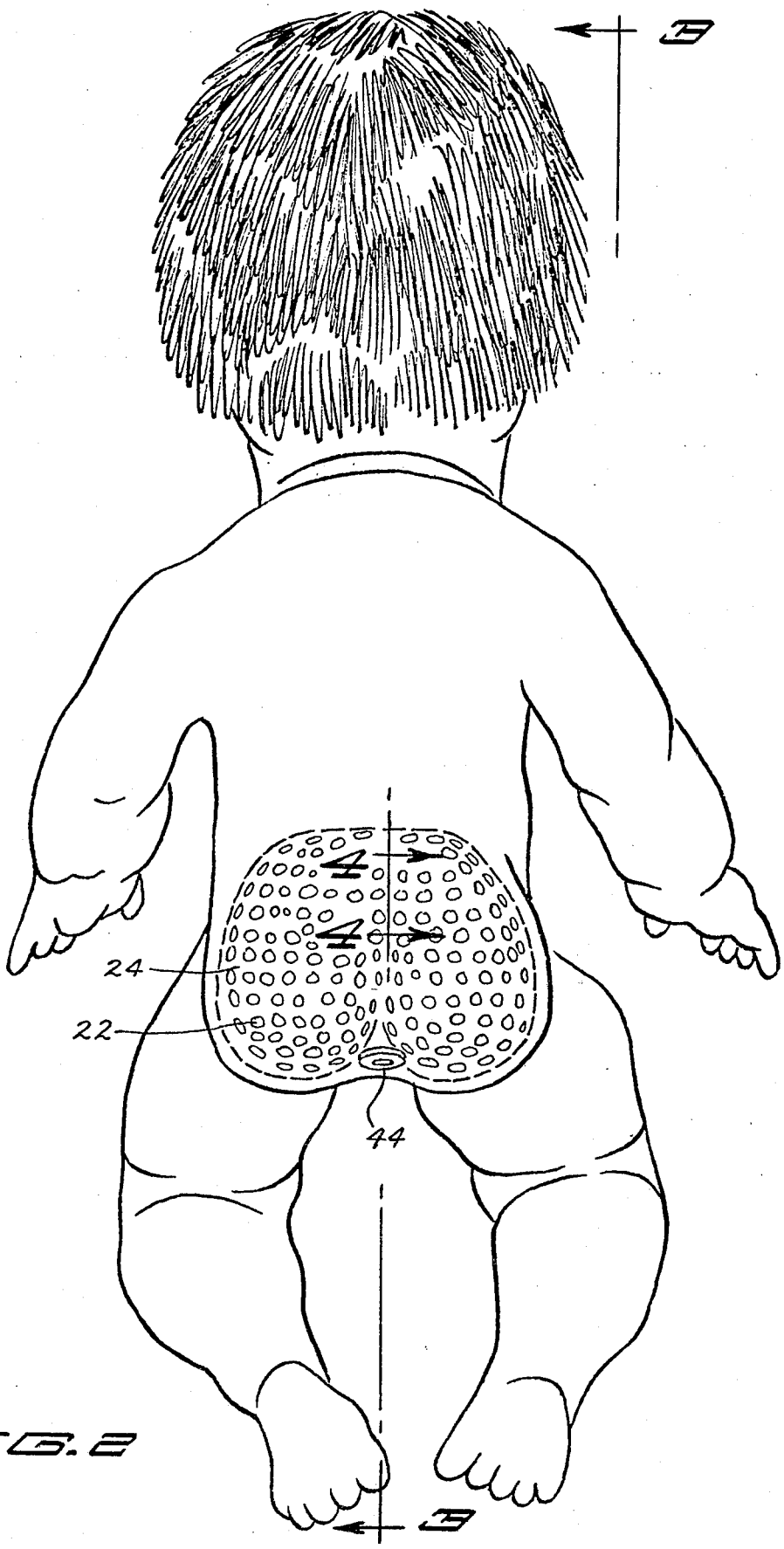
FIG. 2 is a rear elevational view of the doll embodiment.

The present invention relates to toy dolls and figurines which are reversibly adapted to change color in response to changes in the hydrogen ion activity of aqueous solutions applied to them. For convenience, the following detailed description is set forth with particular emphasis on toy dolls. It should be understood, however, that the present invention contemplates other amusement devices including animate-like figurines of, for example, creatures such as frogs, alligators, space monsters, chameleons and the like.

Referring now to the drawings, and to FIG. 1 in particular, there is shown the general configuration of a doll having a body 10, a pair of arms 12, a pair of legs 14, and a head 16. The doll is depicted as wearing a dress 18 as well as a diaper 20. A portion of the doll's skin incorporates the reversibly changeable color feature 22 of the present invention. As seen more clearly in FIG. 2, which is a rear view of the preferred doll embodiment, the present invention is shown as including a random array of rash dots 24.

Figures 3, 6:
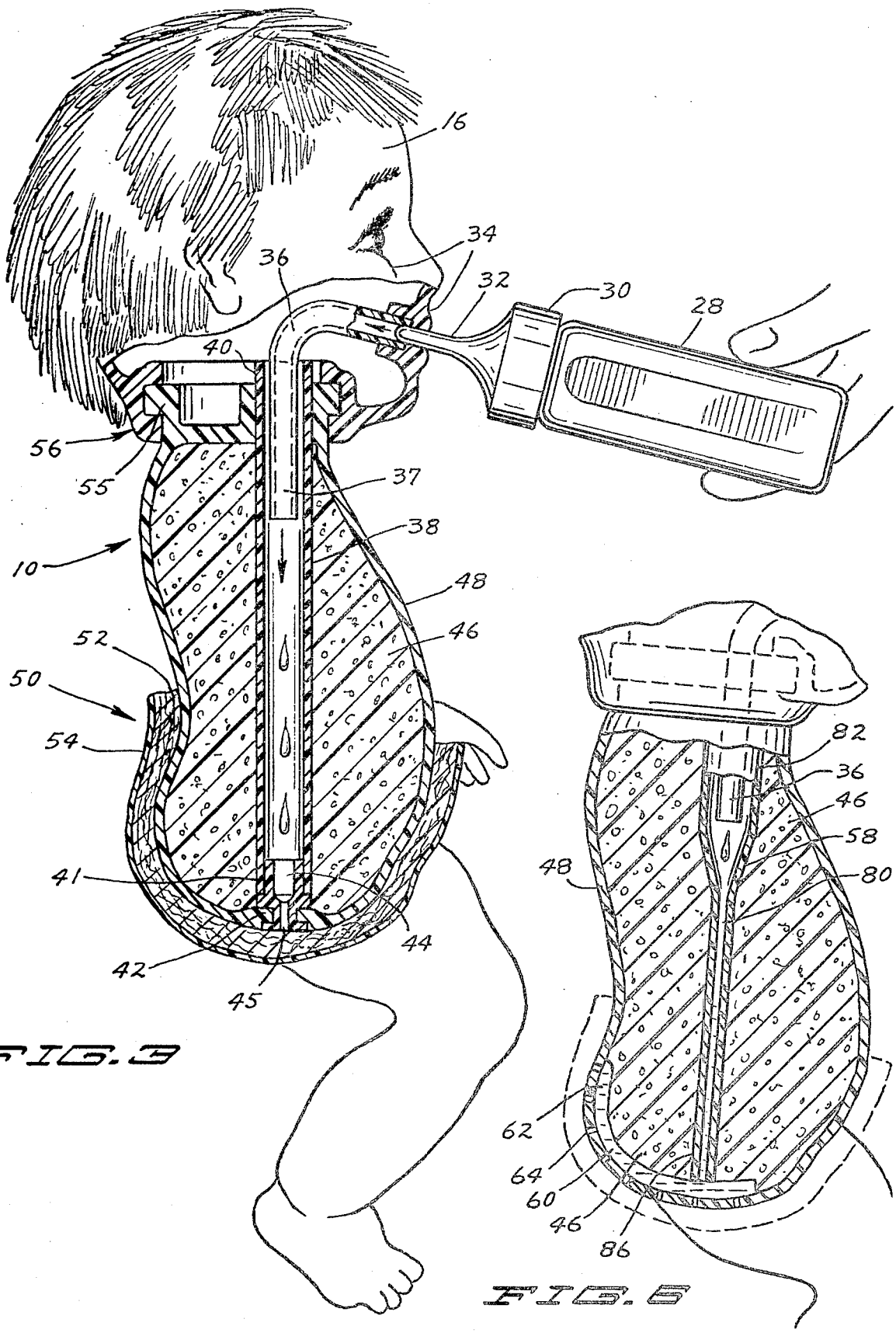
FIG. 3 is a partial vertical sectional view taken along lines 3—3 of FIG. 2.
FIG. 6 is a partial sectional view showing another embodiment of the invention; and, FIG. 7 is an enlarged sectional view of another embodiment of the coated skin similar to that shown in FIG. 4.

As can be seen more clearly in FIG. 3, the preferred embodiment of the present invention comprises a conventional wetting doll which is well known in the art. FIG. 3 is a partially cut-away sectional view along lines 3—3 of FIG. 2. The head 16, is rotably attached to the body 10. Rotation of the doll head 16 is allowed by the doll head having a grooved neck collar 56 which encircles a flange 55 forming an integral part of the doll body. This construction permits rotational movement of the head relative to the body. A mouth 34 forms an opening into the head, and a short orifice tube 36 projects inwardly from the mouth. The free end 37 of the tube 36 is rotably inserted into a first end 40 of an elongated tube 38. As illustrated, the inside diameter of the tube 38 exceeds the outside diameter of the orifice tube 36. This construction permits unrestricted rotation of the doll head relative to the body. A plug 42 is inserted into the second end 41 of the body tube 38, and it has an outer diameter slightly less than the body tube such that a tight fit results. The plug serves to restrict or to impede the flow of any aqueous solution through the tube. A passage 44 in the plug provides a discharge opening 45 in the posterior of the doll's body 10.

A bottle 28 is used for introducing an aqueous solution into the doll. As depicted in FIG. 3, a bottle cap 30 which terminates in a tapered nipple 32, is insertable into the doll's mouth 34.

Typically, the body cavity is filled with stuffing of any suitable material 56 such as polyester, polyurethane foam or the like. The doll body 10 has a resilient, flexible skin 48 of any conventional suitable material such as polyurethane or vinyl plastisols.

The doll can wear a 2-ply diaper 50, formed of a first-ply or layer 52 and a second ply or layer 54. The ply closest to the doll's skin 48 is water absorbent and typically is made of cellulosic material such as paper, although an open-cell foam also is suitable. The ply 52 serves to receive aqueous solutions which exit from the body tube 38 through the discharge opening 44, and to evenly distribute more or less, the aqueous solution over that coated skin portion 22 of the doll's skin 48 which incorporates the present invention's feature. Additionally, the water-absorbent ply 52 allows longer contact periods between the aqueous solution and the coated skin portion 22. A second ply 54 is bonded to the paper ply and it is water impermeable. The ply 54 is made from such conventionally suitable materials as plastic (e.g., polyvinyl chloride).

It should be recognized that FIG. 3 shows just one manner of those known in the art in which aqueous solutions are adapted to pass from the doll mouth to the doll posterior and means for distribution of the aqueous solution thereover.

Before proceeding with a detailed description of the doll's surface which is capable of changing color, a brief reference will be made to FIG. 6 which illustrates another embodiment of a conventional wetting doll. This embodiment does not require a diaper to assist the distribution of aqueous solutions around the coated region. FIG. 6 is a partially cut away sectional view which is somewhat similar to that shown in FIG. 3. The orifice tube 36 is rotably insertable into the first end 82 of the second type of body tube 80. The body tube 80 has a tapered region 58 which reduces the inside and outside diameters of the body tube. A second end 86 of the tube terminates proximate the doll's posterior. The reduced diameter of the body tube 80 serves to restrict liquid flow and thus the liquid flow rate through the tube. The second end 86 of the tube is connected to a liquid reservoir 60 which is formed by a liner 62 attached to the inner surface of the skin 48 by appropriate means. As illustrated, the reservoir 60 is located between the doll's skin and the body fill material 46. A plurality of apertures 64 are provided in the doll skin 48 on the region of the doll's posterior. The reservoir serves to reduce liquid flow and to evenly distribute more or less, the liquid about the region simulating excretion of body fluids. The body fill liner 62 is water impermeable so as to prevent the liquid from soaking into the body fill material 46. The apertures 64 permit the release of the liquid from the liquid reservoir 60 to the outer surface of the doll's body. The skilled artisan can easily adjust the size and number of these apertures to achieve any desired liquid flow rate. FIG. 6 shows just another manner of those many known in the art in which dolls are adapted to pass aqueous solutions from the doll mouth to the doll posterior and means for distribution of the aqueous solution thereover.

A. Base Coat Layer

Referring now to FIG. 4, there is shown a greatly enlarged sectional view taken along 4—4 of FIG. 2. In FIG. 4 there is shown a first, continuous layer 66 or "base coat" as used herein which is an essential element of the most preferred embodiment of the present invention. The base coat is shown adhering to the doll skin 48. Such a base coat layer provides a "primer" or an adherent surface to which can be applied the color coat which is described more fully below. Such a base coat layer is particularly desirable when the doll's exterior surface is non-adherent in nature (e.g., porcelain). When the doll's skin or external surface is made of such conventional synthetic materials as vinyl acrylate, the base coat additionally serves to seal the skin and thereby to reduce the undesirable migration of plasticizers from the vinyl material of the skin into the color layer. In a preferred embodiment, the base coat layer is at least about 1 mil in thickness. Thus, it should be recognized that the thickness of the elements in FIG. 4 depict only relative differences rather than absolute. Most preferably, the base coat is at least about 2 mils in thickness.

The base coat comprises a mixture of film-forming polymeric materials which are hydrophobic. An example of material useful herein as base coat materials is a mixture of (1) polymethyl methacrylate, e.g., having a Brookfield viscosity of about 700–1400 centipoise at 35% solids in methylethyl ketone; and, (2) vinyl acetate/chloride copolymer, e.g., having a viscosity of about 50–100 centipoise at 10% solids in methylethyl ketone and wherein the weight ratio of polymethyl methacrylate to vinyl acetate/vinyl chloride is from about 2.0:1 to 2.5:1. Other acrylic polymeric materials can be used such as polybutyl methacrylate. Similarly, other vinyl chloride polymeric materials are usefully employed such as polyvinyl chloride and polyvinylidene chloride.

Typically, the mixture of polymeric material is applied to the doll's skin in solution with suitable diluents such as methylethyl ketone or methylisobutyl ketone. After application to the skin by spraying, for example, the diluent(s) is allowed to dry under ambient conditions to form the base coat of suitable thickness. Drying can be expedited by employing temperatures of about 100° F.

B. Color Layer

In FIG. 4 there is shown a second layer 68 which is repeatedly capable of reversibly changing color. The second layer is adapted to change color in response to changes in the pH of water solutions applied to the second layer. This second layer, or "color layer" as used herein, is shown adhering to the base coat layer. In the embodiment shown in FIG. 4, the color layer 68 is discontinuous, i.e., comprises separate areas. When generally circular in configuration, these areas are called rash dots. Such rash dots 24 are shown in FIG. 2. As detailed in FIG. 4, such rash dots comprise color materials in a matrix of film-forming polymers which are both flexible and hydrophilic. A dotted array 26 of such rash dots 24 is shown in FIG. 2. Such a dotted array can be either random or organized.

Figure 7:
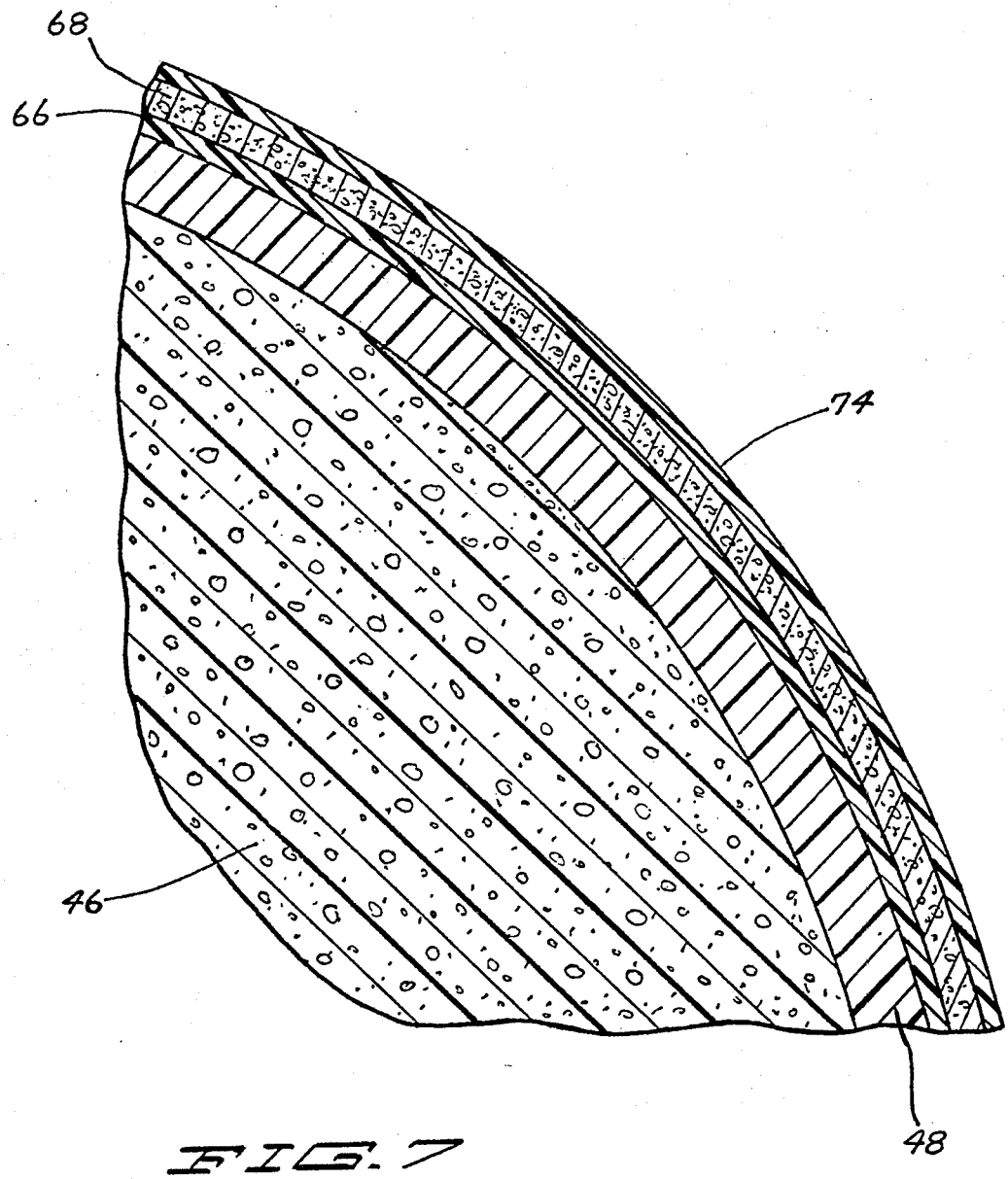

FIG. 7 shows another embodiment of the color layer 68. In this embodiment, the reversibly changeable feature comprises a continuous layer of more or less even thickness.

Suitable color materials for use in the color layer are those substances which change color in response to the hydrogen activity of aqueous solutions applied to them, i.e., typical pH or "acid-base" indicators. A wide variety of such materials are known and their properties, e.g., color and pH transition range, are disclosed in "PH and Electro Titrations", by I. M. Kolthoff and H. A. Laitinen, John Wiley & Sons, Inc. 1941, P. 29 and "Acid-Base Indicators", I. M. Kolthoff and C. Rosenblumm, Chapter 5, the MacMillan Company, 1936, each of which are incorporated herein by reference. Some suitable materials are given in TABLE I below.

TABLE I

ACID-BASE INDICATORS

| Common Name | Transition Range (pH) | Color Change Acid | Color Change Base |
|---|---|---|---|
| Methyl violet | 0.5–1.5 | yellow | blue |
| Thymol Blue | 1.2–2.8 | red | yellow |
| | 8.0–9.6 | yellow | blue |
| Methyl yellow | 2.9–4.0 | red | yellow |
| Methyl orange | 3.1–4.4 | red | yellow |
| Bromcresol green | 3.8–5.4 | yellow | blue |
| Methyl red | 4.2–6.3 | red | yellow |
| Chlorophenol red | 4.8–6.4 | yellow | red |
| Bromthymol blue | 6.0–7.6 | yellow | blue |
| Phenol red | 6.4–8.0 | yellow | red |
| Neutral red | 6.8–8.0 | red | yellow/ orange |
| Cresol purple | 7.4–9.0 | yellow | purple |
| | 1.2–2.8 | red | yellow |
| Phenolphthalein | 8.0–9.6 | colorless | red |
| Thymolphthalein | 9.3–10.5 | colorless | blue |
| Alizarin yellow | 10.1–12.0 | colorless | violet |

Preferred reversible color indicating materials are solid at room temperatures (e.g., 25° C.) although liquid materials can be used. More preferred materials are colorless below their pH transition range. Specific, preferred reversible color materials include chlorophenol red, phenolphthalein, and phenol red. Best results are achieved using phenolphthalein as the acid-base indicator.

The reversible color material of the color layer or rash dot is essentially matrixed in a mixture of film-forming hydrophilic material. A first polymeric component of the matrix enables the color layer or rash dot to adhere to the base coat. Suitable such polymers or "binders" include cellulose acetate propionate and cellulose acetate butyrate. For best results, cellulose acetate propionate is employed as the film-forming binder polymer. The weight ratio between the reversible color material to binder polymer ranges from about 0.6:1 to 2.6:1. Optionally, the binder additionally includes a plasticizer to improve the color layer flexibility and to improve film clarity. Suitable optional binder coat plasticizer materials include butyl benzyl phthalate, diethyl phthalate, dibutyl phosphate, dioctyl phthalate and tricresyl phthalate. If present, such optional binder materials comprise from about 1% to 5% of the first polymeric component of the color coat layer.

A second polymeric component of the color coat layer matrix material is a second film-forming polymer which is highly water absorbent and is referred to herein as a wicking component. The wicking component serves to accelerate the transport of water to the reversible color material. Suitable wicking component materials include hydroxyethyl cellulose, hydroxypropyl cellulose, sodium carboxymethyl cellulose and fumed silicon dioxide. The preferred material for the wicking component is hydroxyethyl cellulose. The weight ratio between the binder component and the wicking component ranges from about 2:1 to 17:1.

In a highly preferred embodiment seen more clearly in FIG. 5, the rash dot 24 comprises agglomerates 70 of smaller particles 72 in the matrix of film-forming polymers. These smaller particles 72 are the capsules of microencapsulated reversible color materials that are distributed throughout the rash dot. Provision of the color material in microencapsulated form unexpectedly and greatly extends the number of cycles through which the color change can be reversed.

Since the color materials used herein are at least partially water soluble, some of the color material is leached out by the applied aqueous solutions during color reversals. Encapsulation of the color material markedly reduces the amount of color material solubilized by the contacting aqueous solutions and thus greatly extends the number of cycles of color reversal provided by a given amount of color material.

Conventional chemical or mechanical microencapsulation methods are used to microencapsulate the acid-base indicating reversible color material. Such techniques are very well known. See, for example, "Microencapsulation" by C. E. Anderson et al, *Management Reports, Inc.* (1963) which is incorporated herein by reference. Typically, microcapsules' nuclei of reversible color material will range in diameter of from about 75 to 250 microns. Wall thickness of the microcapsules will range from about 1 to 5 microns.

Generally, in conventional chemical microencapsulation methods, a hydrophilic colloid which is to become the cell wall of the capsules is simply dispersed in water. To this dispersion is added a slurry of reversible color material in an oil which is immiscible in water. The mixture is agitated to form a colloid-oil/reversible color material-water emulsion. Next, a coacervating salt is added to the emulsion. The effect of the salt is to render the colloid less soluble in water; consequently, a fluid sheath of colloid comes to surround the oil/reversible color material droplet. This is frequently referred to as gelation.

During all of the foregoing steps the temperature of the system is carefully maintained above the melting or solidifying point of the colloidal material. Consequently, to complete the capsules' formation, the temperature of the system needs only to be reduced to the point where the colloidal material becomes solid. The temperature is lowered by adding to the system additional cool coacervation salt aqueous solution.

It is important that the capsules remain porous to allow transport of aqueous solutions to contact the reversible color material in the nuclei of the capsule. The porosity of the capsule wall can be controlled in known manner by manipulating the rate at which the wall material gels. Wall pores will be relatively small if the gelation step is performed rapidly. Conversely, larger pores will be formed in the capsule wall if the gelation step is relatively slow. By varying the relative amounts of colloid and oil and the size of the oil droplets, capsules with tailored wall thickness are obtained.

Suitable oils materials for the microencapsulation process are immiscible in water (i.e., soluble in water to not more than 0.05% by weight at 25° C.) and including for example, cottonseed oil, corn oil, soybean oil, coconut oil, castor oil and olive oil. Preferred oils are intermediate petroleum oils like hexane, cyclohexane and the like.

Suitable colloidal materials are hydrophilic and gelable as well as inert to the reversible color material and other capsule constituents. Useful colloids include gelatin, alginates, casein, starch, pectins, carboxymethyl cellulose, Irish moss and gum arabic. Suitable coacervation salts have cations such as sodium potassium, ammonium and lithium and anions of sulfate, citrate, tartrate, acetate and chloride. Specific examples of coacervation salts include sodium sulfate, sodium citrate, sodium chloride, potassium sulfate, potassium citrate and potassium chloride.

The hues of color realized by the present reversibly changeable color feature of the present invention are influenced by two factors. First, the ratio of color material to matrix material influences the color's hue. When relatively more color material is incorporated into the matrix, stronger hues are realized. Conversely, when lower ratios of color material to total matrix materials are employed, weaker hues are realized. Similarly, the color hue is influenced by the thickness of the color layer. For a given color material to total matrix material weight ratio, the thicker the color layer (or in the preferred embodiment, the rash dot) the stronger the hue.

When microencapsulated color material is used in the color layer, the weight ratio of microencapsulated color material to the binder component of the matrix polymeric material is again from about 0.6:1 to 2.6:1.

C. Top Coat Layer

In FIG. 4 there is shown a top coat layer 74 which also is an essential element of the most preferred embodiment of the present invention. The top coat comprises a thin film over the color layer that serves to provide abrasion resistance to the portion of the doll skin incorporating the present invention. Also, without such a top coat layer, the color layer could be responsive to skin moisture upon handling of the doll. Additionally, without the top coat layer, the capsules of microencapsulated reversible color material could be subject to rupture during normal handling which leads to both color bleeding and greatly reduced cycle life. The top coat is applied over the color coat and adheres thereto. Since aqueous solutions must penetrate the top coat layer in order to effectuate changes in the reversible color material of the color layer, it is essential that the top coat layer be permeable to such aqueous solutions. However, the top coat layer must be relatively insoluble to such aqueous solutions. Otherwise, the top coat layer would be washed away upon use.

Top coat thicknesses are typically less than 1 mil. It is, of course, desirable that the top coat be transparent.

The top coat layer comprises the same two film-forming polymer components as does the color layer matrix material. A first, or "binder" water-insoluble hydrophilic film-forming material(s) enables the top coat layer to adhere to either the rash dots of the color layer or to the base coat layer between the discontinuous regions of the color layer. Suitable materials for the binder component of the top coat layer are those also useful as the "binder" component in the base coat layer, e.g., cellulose acetate propionate or cellulose acetate butyrate, or the like. A second, or "wicking" component of the top coat layer provides the required water absorbtivity to render the top coat layer sufficiently water permeable. Suitable materials for the wicking component of the top coat layer are those also useful as the wicking component of the color coat layer, e.g., hydroxyethyl ethers of cellulose. In the top coat layer, the weight ratio of the binder component to the wicking component should be from about 3:1 to about 7.5:1. Better results are obtained when the weight ratio of binder component to wicking component is from about 3:1 to 5:1.

Resins of suitable polymeric materials are simply dissolved in suitable solvent(s). Thereafter, the solution is applied such as by spraying over the color layer and allowed to dry at ambient conditions.

Optionally, each of the three layers can include a "skin-toner" which is a material that helps the layers match the doll skin in simulated pigmentation. Such skin-toner materials thus enable the reversible changing feature of the present invention to be less conspicuous by allowing the layers to blend in with the skin by virtue of the matched pigmentation. Suitable skin-toner materials include "Dayglo" pigments and Dayglo Soluble Toners marketed by Day-Glo Color Corporation.

Another component which can be included in any of the layers of the present invention is a "flattener" material. Such flattener materials reduce the gloss which can be exhibited by the layers of the present invention. Suitable materials for such flatteners are pyrogenic or "fumed" silicon dioxide such as is described in British Pat. Nos. 987,301 and 1,167,173 each of which is incorporated herein by reference.

INVENTION USE

Typically, a child would fill the bottle 28 with water and add alkaline material in suitable form (e.g., prepared tablets) sufficient to raise the pH of the resulting aqueous solution to in excess of 10. After the bottle cap 30 is secured to the bottle, the bottle is shaken with sufficient vigor for sufficient time so as to allow the complete dissolution of the added alkaline material. Thereafter, the nipple 32 of the bottle cap 30 is inserted into the aperture formed by the mouth 34 in the doll's head. The alkaline aqueous solution flows into the body tube 38 by gravity. After being discharged through the discharge opening 44, the aqueous solution is more or less uniformly distributed over the treated skin portion incorporating the reversible color feature of the present invention. The alkaline aqueous solution quickly penetrates through the top coat layer into the rash dots. There, the aqueous solution penetrates the porous cell walls of the capsules and contacts the reversible color material contained in the nuclei. The contact between the alkaline aqueous solution and the microencapsulated reversible color material causes the color material to change color in response to the hydrogen ion activity of the contacting aqueous solution. The color change so caused is manifested within a few seconds and simulates the appearance of a diaper rash.

To simulate alleviation of the diaper rash condition by reversibly changing the color of the rash dot to its original color or colorless condition, the alkaline water-impregnated diaper is first removed. Thereafter, an acidic aqueous solution or "lotion" having a pH of less than 5 is applied to the portion of the doll skin incorporating the reversibly changeable color feature of the present invention. The lotion is prepared by mixing sufficient quantites of acid material so as to achieve a solution pH of about 4. The lotion can be applied to the doll skin using a simple open-celled plastic foam pad, designated generally by numeral 76. Upon swabbing the treated skin portion with acidic aqueous solution, the acidic aqueous solution quickly penetrates the top coat layer and enters into the nuclei of the microencapsulated reversible color material. The reversible color material again responds to changes in the pH or hydrogen ion activity of the aqueous solution applied thereto. The contact between the reversible color material and the low pH aqueous solution causes the reversible color material to revert back to the original colored or colorless condition that obtained previous to the contact with the alkaline solution. The reversion which occurs within a few minutes of exposure to the acidic water, simulates a "curative" effect. This action is repeatable with no detectable change in functional characteristics being noted after several dozen cycles.

The reversibly changeable color features of the present invention are illustrated by the following examples:

EXAMPLE I

A. Base Coat Layer

The following composition is prepared:

| Component | Weight % |
|---|---|
| Polymethyl methacrylate resin[1] | 12% |
| Vinyl acetate/vinyl chloride co-polymer[2] | 6% |
| Methylisobutyl ketone | 21% |
| Methylethyl ketone | 52% |
| Cellosolve acetate[3] | 8.97% |
| Flattener[4] | .03% |
| | 100% |

[1]"Acyloid" A-101 (marketed by Rohm & Haus) having density of 7.9 lb./gal. and a Brookfield viscosity (25° C.) of between 700–1400 cp. at 40% by weight resin in methylethetyl ketone; a solubility parameter of 9.4 and a Tg° C. of 105° C.
[2]A high molecular weight (i.e., a Brookfield viscosity of 200–400 cp. at 17% solution of resin in 70:30 methylethetyl ketone: toluene at 25° C.) vinyl chloride-vinyl acetate copolymer comprising approximately 89% by weight polyvinyl chloride marketed by Union Carbide Corporation as "Bakelit VYNS".
[3]A retarder solvent, i.e., an optional additive to decrease the volatility of the solvent.
[4]An optional component to reduce gloss such as OK-412 marketed by DeGussa, Inc. and which is a fumed silicon dioxide.

Resins of the plastic components and the retarder solvent as well as the flattener are dissolved into the ketone solvents by mild agitation for 15 minutes.

0.05 grams of the base coat are sprayed onto the desired portion of a doll skin comprising about 5 square inches and allowed to dry by solvent evaporation at room temperature for 15 minutes. A film approximately 1.5 mil is formed adhering to the surface of the doll skin.

B. Color Layer

Thereafter, the following compositions are prepared:

| 1. | Binder Component | Weight % |
|---|---|---|
| | Cellulose acetate propionate* | 7.5% |
| | Plasticizer (butyl benzyl phthalate) | 2.0% |
| | Anhydrous ispropyl alcohol | 79% |
| | Color | 0.01% |
| | Deionzied water | g.s. |
| | | 100% |

*marketed by Eastman Chemical Products, Inc. as CAP-504

The deionized water, color and isopropyl alcohol are first mixed. Thereafter, the cellulose acetate propionate and plasticizer are slowly added with vigorous agitation and the agitation is continued until the cellulose acetate propionate and plasticizer are completely dissolved.

The following composition is prepared:

| 2. | Wicking Component | Weight % |
|---|---|---|
| | Hydroxyethyl cellulose* | 8% |
| | Plasticizer (dioctyl butyl phthalate) | 3% |
| | Sodium benzoate | 0.5% |
| | Deionized water | g.s. |
| | | 100% |

"*Natrosol" 250 LR marketed by Hercules, Inc.

The hydroxyethyl cellulose, plasticizer and the sodium benzoate are each added slowly to the water using vigorous agitation. Agitation is continued until the hydroxyethyl cellulose is completely dissolved.

Thereafter, the following color composition is prepared:

| Component | Weight % |
|---|---|
| Binder Component | 70% |
| Wicking Component | 18% |
| Microencapsulated phenolphthalein* | 12% |
| | 100% |

*marketed by Appleton Papers, Inc., Capsular Products Division and having a particle size of approximately 100 microns and a wall thickness of approximately 1 mil.

The color composition is prepared by slowly adding the cellulose component to the binder component as prepared above using vigourous agitation. Thereafter, the microencapsulated phenolphthalien is slowly added using mild agitation.

Rash dots of about 0.25–0.5 inch in diameter are hand made by painting the color composition prepared above using approximately 0.06 g. of the color composition. The rash dots are allowed to dry by solvent evaporation at room temperature for 15 minutes. A dot approximately 4 mil in thickness is produced.

C. Top Coat Layer

The following composition is prepared:

| 1. | Binder Component | Weight % |
|---|---|---|
| | Cellulose acetate butyrate* | 7.5% |
| | Anhydrous isopropyl alcohol | 80.0% |
| | Color | 0.03% |
| | Deionized water | q.s. |

-continued

| 1. | Binder Component | Weight % |
|---|---|---|
| | | 100% |

*CAB 553 marketed by Eastman Chemical Products, Inc.

The cellulose acetate butyrate is slowly added to the mixture of isopropyl alcohol, color and deionized water using vigorous agitation. Agitation is continued until the cellulose acetate butyrate is completely dissolved.

The following composition is prepared:

| 2. | Wicking Component | Weight % |
|---|---|---|
| | Hydroxyethyl cellulose* | 8% |
| | Plasticizer (dioctyl butyl phthalate) | 2% |
| | Sodium benzoate | 0.5% |
| | Distilled water | q.s. |
| | | 100% |

*"Natrosol" 250 LR marketed by Hercules, Inc.

Such a wicking agent is prepared in a similar manner to the wicking component of the color layer described above.

Thereafter, the following top coat composition is prepared.

| Component | Weight % |
|---|---|
| Binder Component | 7% |
| Wicking Component | 5% |
| Diacetone alcohol | q.s. |
| | 100% |

Such a top coat composition is prepared by simple mixing of two components with mild agitation. The top coat layer is produced by spraying the top coat composition over the entire area of the doll skin having the reversibly changeable color feature of the present invention. A continuous film of under 1 mil in thickness is produced when approximately 0.065 g. is used to coat approximately 5 square inches. After application by spraying, the top coat layer is allowed to dry by solvent evaporation for 15 minutes at ambient conditions.

The doll so prepared exhibits a simulated diaper rash when that portion of the doll skin incorporating the color feature of the present invention is contacted with a water solution having a pH of 10. The color change occurs only a few seconds after contact with the high pH water.

EXAMPLE II

A. Base Coat Layer

A base coat layer composition as in Example I is prepared. 0.05 g. of the base coat are sprayed onto the desired portion of the skin of a doll as shown in FIG. 3 comprising about 5 square inches and allowed to dry by solvent evaporation at room temperature for 20 minutes. A film approximately 1 mil is formed adhering to the surface of the doll skin.

B. Color Layer

Thereafter, the following color layer composition is prepared.

| Amount | Component | Weight % |
|---|---|---|
| 90.5 g | Methyl alcohol | 78.70% |
| 2.0 | Butyl benzyl phthalate | 1.74% |
| 7.5 | Cellulose acetate propionate* | 6.52% |
| 5.0 | Hydroxypropyl cellulose | 4.35% |
| 10.0 | Microencapsulated pheonol red | 8.69% |
| | | 100% |

*marketed by Eastman Chemical Products, Inc. as CAP-504

The methyl alcohol and benzyl butyl phthalate are first mixed. Then, with vigorous agitation, the cellulose propionate is slowly added. The agitation is continued until the cellulose acetate propionate is completely dissolved. Vigorous agitation is continued while the hydroxypropyl cellulose is added until it is dissolved. Then, the encapsulated phenol red is added using mild agitation.

Rash dots 0.25–0.5 inch in diameter are made by painting the color layer composition as in Example I except that dots approximately 2 mil in thickness are prepared by using less color layer composition per dot. After drying for 20 minutes, several dots randomly chosen are hand painted a second time and are allowed to dry. These dots range in thickness from 4 to 8 mil.

C. Top Coat Layer

Thereafter, the following top coat layer composition is prepared:

| Amount | Component | Weight % |
|---|---|---|
| 90.5g | Methyl alcohol | 86.20% |
| 2.0 | Butyl benzyl phthalate | 1.90% |
| 7.5 | Cellulose acetate propionate* | 7.14% |
| 5.0 | Hydroxypropyl cellulose | 4.76% |
| | | 100% |

*marketed by Eastman Chemical Products, Inc. as CAP-504

The top coat layer composition is prepared in a similar manner as the color layer composition except for the addition of the encapsulated reversible color material.

The top coat layer is applied by spraying the composition prepared as desired above and by solvent drying for 20 minutes at ambient conditions.

The wetting dolls having the reversibly changeable feature of the present invention prepared as described above exhibits a bright red color when "fed" with an aqueous solution having a pH of 8.5 or above. The color change occurs approximately 30–60 seconds after being "fed" with the high pH aqueous solution.

When the portion of the doll's skin possessing the color feature of the present invention is thereafter swabbed with a foam pad carrying an aqueous solution having a pH of about 3, the color disappears after about 10 seconds as the pH material reverts back to a colorless condition. If dried, the skin remains colorless.

Dolls exhibiting substantially similar reversibly changeable color features are realized when in the Example II color layer composition the solvent methyl alcohol is replaced with an equivalent amount of ethyl alcohol or the diluent comprising isopropyl alcohol and water in a weight ratio of alcohol to water of about 9:1.

EXAMPLE III

The skin portion of a wetting doll having the structure of FIG. 6 is coated with a base coat and color as in Example II. Then, the following top coat layer composition is prepared:

| Component | Weight % |
|---|---|
| Cellulose acetate butyrate* | 4.51% |
| Anhydrous isopropyl alcohol | 72.20% |
| Deionized water | 19.01% |
| Butyl benzyl phthalate | 1.79% |
| Fumed silicon dioxide** | 2.59% |
| (Cab-O-Sil: grade M-5) | 100% |

*CAB-553 marketed by Eastman Chemical Products, Inc.
**A pyrogenic silica (Cabot Corp.) having a particle diameter between 0.001 and 0.03 microns.

The above ingredients were blended together and placed in a ball mill and milled for 72 hours.

Then, about 10% by weight diacetone alcohol as an additional diluent is added to the top coat layer prior to use using mild agitation. Thereafter, the top coat layer is prepared by spraying the top coat composition onto the doll skin and allowing it to dry.

What is claimed is;

1. An animate-like figurine repeatedly capable of reversibly changing color, comprising a body having an outer surface simulating the skin of an animate being at least a portion of said surface being overlaid by an adherent layer containing microencapsulated pH-indicating material that is adapted to reversibly change color in response to changes in the hydrogen ion activity of water solutions applied thereto.

2. An animate-like figurine repeatedly capable of reversibly changing color, comprising a body having an outer surface simulating the skin of an animate being at least a portion of said surface being overlaid by:

A. a first layer for sealing the skin to provide a continuous adherent surface;

B. a second layer of pH-indicating material adhered to at least a portion of the first layer adapted to reversibly change color in response to changes in the hydrogen ion activity of water solutions applied thereto.

3. An animate-like figurine of claim 2 wherein the second layer is in the form of a plurality of irregularly shaped areas.

4. The animate-like figurine of claim 2 wherein the second layer is in the form of an array of roughly circular dots.

5. The figurine of claim 2 wherein the pH-indicating material is microencapsulated.

6. An animate-like figurine comprising a body having an outer surface simulating the skin of an animate being at least a portion of said surface being overlaid by:

A. a first layer for sealing the skin to provide a continuous adherent surface;

B. a second layer of pH-indicating material adhered to at least a portion of the first layer adapted to reversibly change color in response to changes in the hydrogen ion activity of water solutions applied thereto; and C. a third layer super-imposed over said second layer for protecting said second layer from abrasion and which is water permeable, to form a coated skin portion while maintaining said simulation of the skin of said being.

7. The animate-like figurine of claim 5 wherein the second layer includes a microencapsulated pH-indicating material.

8. The animate-like figurine of claim 7 wherein the second layer is in the form of an array of roughly circular dots.

9. The animate-like figurine of claim 7 wherein the second layer is in the form of an array of irregularly shaped areas.

10. The animate-like figurine of claim 9 wherein the body is in the shape of a doll.

11. The doll of claim 10 having a mouth and means for passing water from the mouth to the coated skin portion.

12. The doll according to claim 10 wherein the first layer comprises a flexible, film-forming polymeric material which is hydrophobic.

13. The doll according to claim 12 wherein the third layer comprises a flexible film-forming polymeric material which is water permeable.

14. The doll according to claim 13 wherein the polymeric material of the first layer comprises a mixture of a first polymer selected from the group consisting of polymethyl methacrylate and polybutyl methacrylate and a second polymer selected from the group consisting of polyvinyl chloride, polyvinylidene chloride and polyvinyl chloride-vinyl acetate copolymer, and wherein the weight ratio of the first polymer to the second polymer ranges from about 2.0:1 to 2.5:1.

15. The doll according to claim 14 wherein the polymeric material of the second layer comprises a mixture of a binding polymer selected from the group consisting of cellulose acetate propionate and cellulose acetate butyrate and a wicking polymer selected from the group consisting of hydroxyethyl cellulose, hydroxypropyl cellulose, sodium carboxymethyl cellulose, and fumed silicon dioxide and wherein the weight ratio of the binding polymer to the wicking polymer ranges from about 2:1 to 17:1.

16. The doll according to claim 15 wherein the polymeric material of the third layer comprises a mixture of a binding polymer selected from the group consisting of cellulose acetate propionate and cellulose acetate butyrate and a wicking polymer selected from the group consisting of hydroxyethyl cellulose, carboxymethyl cellulose and fumed silicon dioxide and wherein the weight ratio of the binding polymer to the wicking polymer ranges from about 2:1 to 17:1.

17. The doll according to claim 16 wherein the thickness of the first layer is at least about one mil, the thickness of the second layer is about 1 to 40 mils, and the thickness of the third layer is at least about one mil.

18. The doll according to claim 17 wherein the microencapsulated pH indicator comprises capsules of about 75 to 250 microns in thickness and having a cell wall material comprising a member selected from the group consisting of gelatin, alginates, casein, starch, pectins, carboxymethyl cellulose, Irish moss and gum arabic.

19. The doll according to claim 18 wherein the microencapsulated pH material is selected from the group consisting of chlorophenol red, phenolphthalein and phenol red.

20. The doll according to claim 19 wherein the pH material is phenolthalein.

* * * * *

UNITED STATES PATENT AND TRADEMARK OFFICE

CERTIFICATE OF CORRECTION

PATENT NO. : 4,257,188

DATED : March 24, 1981

INVENTOR(S) : David L. Barker

It is certified that error appears in the above-identified patent and that said Letters Patent are hereby corrected as shown below:

Column 10, line 12 - Remove " g " and insert -- q -- .

Column 10, line 27 - Remove " g " and insert -- q -- .

Column 14, line 1 - Remove " 5 " and insert -- 6 -- .

Signed and Sealed this

*Sixth* Day of *October 1981*

[SEAL]

*Attest:*

GERALD J. MOSSINGHOFF

*Attesting Officer*

*Commissioner of Patents and Trademarks*